US006006817A

United States Patent [19]

Stone et al.

[11] Patent Number: 6,006,817

[45] Date of Patent: Dec. 28, 1999

[54] OVERHEAD DOOR, PANEL AND HINGE ASSEMBLY

[75] Inventors: Jeffery W. Stone, Cincinnati, Ohio; Thomas E. Youtsey, Southgate, Ky.; Richard J. Lewis, Jr., Loveland; William J. White, Cincinnati, both of Ohio

[73] Assignee: Clopay Building Products Company, Cincinnati, Ohio

[21] Appl. No.: 09/005,628

[22] Filed: Jan. 9, 1998

[51] Int. Cl.[6] ..... E05D 15/06

[52] U.S. Cl. ..... 160/201; 160/229.1; 160/236

[58] Field of Search ..... 160/201, 229.1, 160/236; 16/266, 380

[56] References Cited

U.S. PATENT DOCUMENTS

| | | |
|---|---|---|
| 269,986 | 1/1883 | Alexander . |
| 1,030,801 | 6/1912 | Berault . |
| 1,174,539 | 3/1916 | Bauer . |
| 1,697,772 | 1/1929 | Lewis . |
| 2,196,903 | 4/1940 | Rowe et al. . |
| 2,233,351 | 2/1941 | Rowe . |
| 2,257,513 | 9/1941 | Pilcher . |
| 2,372,792 | 4/1945 | Oswald . |
| 2,391,845 | 12/1945 | Rowe . |
| 2,484,609 | 10/1949 | Clark . |
| 2,494,001 | 1/1950 | Rowe . |
| 2,557,753 | 6/1951 | Mitchell . |
| 2,637,381 | 5/1953 | Bowman . |
| 2,871,932 | 2/1959 | Stroup . |
| 2,952,313 | 9/1960 | Stroup . |
| 3,000,048 | 9/1961 | Harsch . |
| 3,008,175 | 11/1961 | Biedinger et al. . |
| 3,090,427 | 5/1963 | Stroup et al. . |
| 3,104,699 | 9/1963 | Wolf et al. . |
| 3,109,483 | 11/1963 | Merrill . |
| 3,176,757 | 4/1965 | Lomaz . |
| 3,198,242 | 8/1965 | Crosswell . |
| 3,253,552 | 5/1966 | Stein . |
| 3,334,681 | 8/1967 | Crosswell . |
| 3,347,305 | 10/1967 | Urbanick . |
| 3,376,913 | 4/1968 | Clapsaddle . |
| 3,402,457 | 9/1968 | Landow et al. . |
| 3,594,073 | 7/1971 | Liautaud . |
| 3,672,424 | 6/1972 | Brown . |

(List continued on next page.)

FOREIGN PATENT DOCUMENTS

| | | |
|---|---|---|
| 0231833 | 8/1987 | European Pat. Off. . |
| 0394691 | 10/1990 | European Pat. Off. . |
| 0825320 | 2/1998 | European Pat. Off. . |
| 920097 | 3/1947 | France . |
| 2918638 | 11/1979 | Germany . |
| 4019569 | 1/1992 | Germany . |
| 464792 | 7/1951 | Italy . |
| 124686 | 4/1919 | United Kingdom . |
| WO95/31627 | 11/1995 | WIPO . |
| WO97/02401 | 7/1996 | WIPO . |
| WO97/10405 | 3/1997 | WIPO . |

OTHER PUBLICATIONS

Clopay, *We Look Right At Home*, and additional drawings of products disclosed therein, Brochure, circa 1995.

*Primary Examiner*—Blair M. Johnson
*Attorney, Agent, or Firm*—Wood, Herron & Evans, L.L.P.

[57] ABSTRACT

An overhead door includes a plurality of panels pivotally connected to one another with the mating upper and lower edges of the adjacent panels providing a pinch-resistant configuration during articulation of the overhead door. Additionally, the installation and assembly of the door is more easily and efficiently accomplished because of first and second contact locations between the mating upper and lower edges of the panels and the configuration of those contact locations provides registration or alignment of the panels relative to one another during installation. Additionally, the hinge assembly includes a pivot axis which is positioned between the front and back faces of the panel to enhance the pinch-resistant operation of the door and the installation of the hinge is easily accomplished with a reduced number of parts because of cooperating keyhole slots and key on the pivot pin of the hinge.

36 Claims, 6 Drawing Sheets

U.S. PATENT DOCUMENTS 3,740,916 6/1973 Kenaga ..... 160/201
3,772,129 11/1973 Dover .
3,798,839 3/1974 Kaufman .
3,852,943 12/1974 Healy ..... 16/266
3,941,180 3/1976 Thill .
3,980,123 9/1976 Vago .
4,008,745 2/1977 Bailey .
4,073,037 2/1978 Curry et al. .
4,485,544 12/1984 Van Ryswyk .
4,510,663 4/1985 Friesz .
4,589,240 5/1986 Kendall et al. .
4,718,472 1/1988 Hormann .
4,793,397 12/1988 Whiteman .
4,794,972 1/1989 Hormann ..... 160/236
4,854,365 8/1989 Juneau .
4,893,666 1/1990 Hormann .
4,979,553 12/1990 Lowry, III et al. .
4,989,660 2/1991 Wagner .
4,991,639 2/1991 Clay, Jr. et al. .
4,995,441 2/1991 Leist et al. .
5,002,114 3/1991 Hormann ..... 160/201
5,016,700 5/1991 Wegner et al. .
5,040,268 8/1991 Knurr .
5,129,441 7/1992 Leist et al. ..... 160/229.1
5,148,850 9/1992 Urbanick .
5,170,832 12/1992 Wagner .
5,188,163 2/1993 Schwartzengraber et al. ..... 160/201
5,235,724 8/1993 Perrin et al. .
5,365,990 11/1994 Ueda .
5,398,379 3/1995 Kiefer .
5,435,108 7/1995 Overholt et al. ..... 160/236
5,445,207 8/1995 Romanelli et al. .
5,495,640 3/1996 Mullet et al. .
5,509,457 4/1996 Jella ..... 160/201
5,522,446 6/1996 Mullet et al. .
5,551,125 9/1996 Adams .
5,555,923 9/1996 Leist et al. .
5,562,141 10/1996 Mullett et al. ..... 160/201
5,566,740 10/1996 Mullet et al. .
5,588,475 12/1996 Martin ..... 160/236
5,630,459 5/1997 Martin .
5,782,283 7/1998 Kendall ..... 160/201

OVERHEAD DOOR, PANEL AND HINGE ASSEMBLY

BACKGROUND OF THE INVENTION

This invention relates to overhead doors and, more particularly, to an overhead door panel configuration and hinge designs for constructing the overhead door.

There are numerous designs of overhead or retractable door assemblies which are commonly used for garage doors, truck doors, warehouse doors or the like. Typically, an overhead door of this type is convertible between an open, overhead or generally horizontal configuration and a closed generally vertically oriented configuration in which the door closes an opening in the building or the like. The overhead door is typically movable along a track assembly mounted proximate the opening and the track assembly commonly includes a generally vertical track section, a generally horizontal track section and a curved transition track section joining the horizontal and vertical sections together.

Retractable overhead doors of this type are conventionally constructed of a number of vertically arranged, horizontally oriented panels which can fold along the horizontal divisions between the panels to enable the door to pass along the curved transition section of the track when being opened or closed. The panels are pivotally coupled together with hinges on the interior surface or back face of the door panels. Commonly, gaps appear between the adjacent panels while the panels are traveling toward and/or through the curved transition section of the track. Fingers or other foreign objects may be inserted into these gaps by accident or due to improper handling of the door by a user. This is a potentially serious situation which can result in bodily injury.

Recently, many different overhead door designs have been suggested which are aimed at minimizing this hazzard. Commonly, such designs are referred to as "pinch-proof" or "pinch-resistant". These types of door designs often include complicated hinge structures, guards which cover the gaps between the articulating panels or involved and complicated panel geometries to minimize or inhibit the insertion of a probe or other foreign object between the adjacent articulating panels. However, many of these design features have proven to be minimally effective to inhibit and/or prevent such injuries.

An additional drawback of many such door systems is the difficulty associated with the proper installation of the overhead door. For example, proper alignment of the panels relative to one another is very important to maintain a weather tight seal or closure for the garage opening or the like. Furthermore, improper alignment of the panels may result in binding or interference of the adjacent panels during articulation of the door between the open and closed positions. This can result in the door binding or freezing up during articulation or damage to the panels, each of which may require repair, service, replacement or the like.

Further, although the vast majority of overhead garage doors are installed and/or serviced by a professional, it is becoming more common for a do-it-yourselfer such as a homeowner or the like to install the garage door. Installation of the door by an inexperienced individual highlights the need for easy and reliable installation of the system while still providing the pinch-resistant safety features. The complexity of many known door systems, including the design of the respective panels, hinge assemblies and the like, is a clear impediment to proper door installation and operation for not only an experienced installer but an inexperienced installer.

SUMMARY OF THE INVENTION

Therefore, a need exists for an overhead door assembly which can be easily assembled and installed by an experienced or inexperienced installer and still provides a pinch-resistant safety feature to inhibit the insertion of a probe or other foreign object between the articulating panels of the overhead door. Further, such a door system should be easily installed with a minimum number of component parts while still providing a sturdy, weather resistant closure for a garage opening or the like that is easily and safely converted between the open and closed configurations along a track system provided for that purpose.

A presently preferred embodiment of this invention offers these and other advantages over known overhead door, panel and hinge systems. The overhead door according to this invention includes a number of horizontally oriented panels vertically stacked one upon the other in edge-to-edge relationship. The panel design of the door includes an outer, preferably metal skin which extends from a front face of the door panel, around upper and lower edges of the panel and terminates at a hem on the back face of the panel. The upper edge of the panel includes a short landing area or shoulder which projects perpendicularly from the front face of the panel. The upper edge of each panel includes a convex segmented or polygonal surface including four generally planar segments joined together to form the convex shape of the upper edge of the panel. A back face of the upper edge of the panel projects generally parallel to the front face of the panel and terminates at an inwardly turned lip with a hem.

The lower edge of each panel includes a rounded nose portion and a segmented or polygonal concave surface connected thereto. The segmented concave surface preferably includes four generally planar segments connected together to form the concave configuration. The back face of the lower edge of the panel projects generally parallel to the front face and terminates at an inwardly turned lip with a hem.

The panels are coupled to a track assembly mounted proximate the garage opening, warehouse opening, truck opening or the like. The track assembly includes a generally vertical section, a generally horizontal section and a curved transition section joining the horizontal and vertical sections together. A number of rollers are mounted on the panels and coupled to the track assembly to guide the door between a closed generally vertical configuration with the upper and lower edges of the adjacent panels mated together and an open generally horizontal configuration extending generally parallel to the ceiling of the garage or the like.

Advantageously, the mating upper and lower edges of the adjacent panels contact at two locations separated by a gap. The first contact location is formed between the nose on the lower edge of the upper panel and the shoulder on the upper edge of the lower panel. The first contact location is preferably line contact and proximate the front faces of the adjacent panels and helps to provide a weather tight seal against the penetration of rain, wind or other elements when the door is in the closed configuration.

The second contact location between the adjacent panels is planar contact in one preferred embodiment and line contact in a second. Each embodiment includes a downwardly sloping or obliquely angled interface between the upper and lower edges of the adjacent panels when the door is in the closed configuration. A pair of generally planar surfaces, one of which is on the upper edge and the other of which is on the lower edge are in contact to form the second contact location between the mating panels.

Importantly, the downwardly sloping interface of the second contact location aids in the alignment and registration of the panels relative to one another. In particular, during the assembly and installation of the overhead door, the individual panels may be stacked one on top of another forming the overhead door in the closed configuration. During the stacking of the panels, the two contact locations cooperate to align the panels relative to one another primarily so that the respective front and back faces of the adjacent panels are generally coplanar with one another. Furthermore, the configuration of the upper and lower edges, including the two contact locations between the adjacent panels, provides a pinch-resistant configuration to inhibit the insertion of a probe or other foreign object between the panels during articulation. Moreover, the present invention offers pinch resistant protection on all know track radius configurations, whereas certain known designs which claim to offer pinch resistance are limited to larger radius track configurations so that the panels articulate relative to one another no more than 65 degrees. The present invention is not limited in this way and is effective even if the panels articulate as much as 90 degrees relative to one another.

Another important feature of the overhead door according to a presently preferred embodiment of this invention is the hinge assembly that pivotally connects the adjacent panels together. Specifically, the hinge assembly affords very simple and efficient installation of the hinge during the assembly and installation of the door while still minimizing and, in fact, reducing the number of component parts relative to any known hinge designs.

Particularly, a generally U-shaped beam or stile extends between the upper and lower edges of the back face of each panel. Proximate an upper end of the stile is a keyhole slot extending through or into the stile. A first lower portion of the hinge also includes a similarly configured keyhole slot. A pivot pin which includes a protruding key is inserted through the keyhole slots in the hinge and the stile when the keyhole slots are aligned. Alignment of the keyhole slots requires positioning an upper portion of the hinge away from the stile on the adjacent panel to which the hinge will eventually be connected. After the pivot pin is inserted through the keyhole slots, the hinge is pivoted so that the upper portion of the hinge contacts the stile on the adjacent panel. Pivoting the hinge in this manner after the pivot pin has been inserted repositions the keyhole slots relative to one another so that they are misaligned or out of phase. The upper portion of the hinge is then bolted or otherwise connected to the stile on the adjacent panel thereby completing the assembly of the hinge to the adjacent panels. Because the keyhole slots are out of phase when the hinge is finally connected to the panels, the pin cannot be removed. As a result, the assembly method of the hinge according to this invention does not require a separate fastener for the pivot pin thereby simplifying the installation procedure and minimizing inventory and tracking requirements for the component parts of this invention.

Advantageously, the pivot pin and the resulting pivot axis of the hinge is positioned on the stile inwardly from the back face of the panels and between the front and back faces thereof to enhance the pinch-resistant aspect of this design while minimizing material requirements. Specifically, the pivot axis is approximately coincident with the center of curvature of the lower edge of the adjacent panel. The cross-sectional configuration of the concave lower edge of the adjacent panel is non-circular with several polygonal sections or linear segments. The focus of perpendiculars to the polygonal sections at the respective midpoints of the faces of the polygon are at a spot at or near the pivot axis. Preferably, the center of curvature of the polygonal areas defining the concaved lower edge is generally concentric with the pivot axis of the hinge and substantially spaced from the back face of the panels toward the front face of the panels. This design significantly aids in the pinch resistant feature of the design.

An additional feature of the invention which significantly aids in the ease of assembly of the door and associated panels is the attachment mechanism for the stiles to the panels. The attachment of the stiles is accomplished with a minimum number of parts, easily, safely and without structural damage to the panels. Moreover, the center stile on each panel includes a plurality of operator bracket attachment holes for selectively attaching a bracket to the door for use with an automated door opening device.

As a result, the overhead door, panel and hinge assembly of this invention provide a pinch-resistant door which can be easily, efficiently and correctly installed by an experienced or inexperienced person. The unique configuration of the upper and lower edges of the mating panels promotes the registration and alignment of the adjacent panels; whereas, the keyhole slot configuration of the hinge and stile cooperate with the key on the pivot pin for the simple and efficient installation of the hinge assembly with a reduced number of fasteners and parts compared to known hinges.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
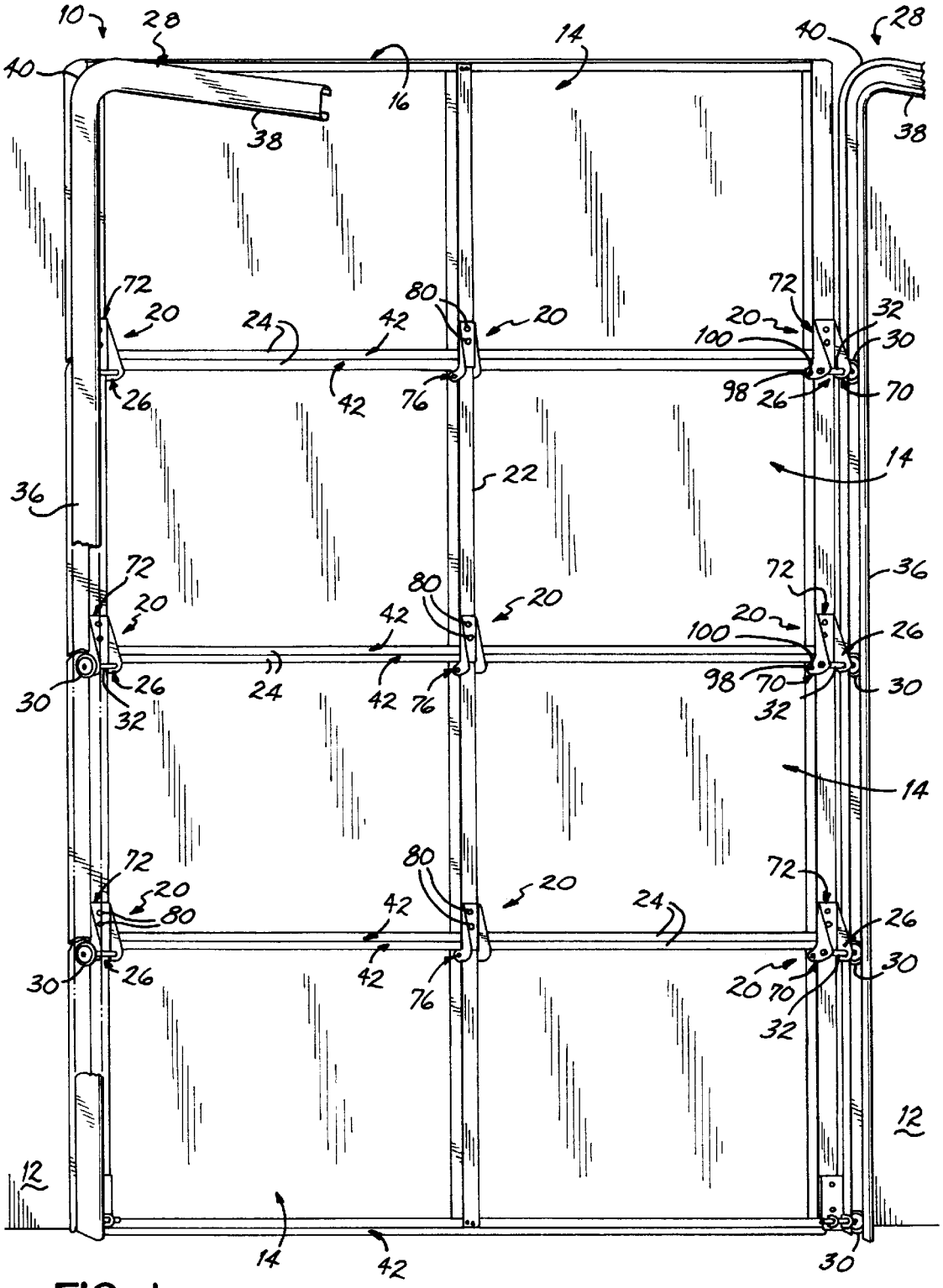
FIG. 1 is a perspective view of a presently preferred embodiment of an overhead door having a number of aligned panels with a portion of a track system broken away showing rollers on the panels of the overhead door.

Referring to FIG. 1, a first presently preferred embodiment of an overhead door 10 according to this invention is shown in a closed generally vertical configuration covering an opening (not shown) in a wall 12 of a garage, warehouse or the like. The door 10 includes a plurality, four of which are shown in FIG. 1, of panels 14. Each panel 14 includes upper and lower generally horizontally oriented edges 16, 18 which are configured to mate with the lower and upper edges 18, 16, respectively, of an adjacent panel 14 when the door 10 is in the closed configuration as shown in FIG. 1.

The adjacent panels 14 are pivotally connected together by a plurality of hinge assemblies 20. In a presently preferred embodiment, two outer hinge assemblies 20 and one center hinge assembly 20 is provided at the juncture between each pair of adjacent panels 14. The hinge assemblies 20 are connected to vertically extending U-shaped beams or stiles 22 on the door panels 14. The stiles 22 extend toward and between the upper and lower edges 16, 18 of the panels 14 and are positioned proximate a back face 24 of each panel 14. Preferably, each of the stiles 22 are 20 gauge hot galvanized cold rolled steel. The lateral end stiles 22 each preferably include a finished rounded outer edge or the like so that the opposing end stiles 22 on each panel 14 are mirror images of one another.

The outer hinge assemblies 20 each include a roller assembly 26 for coupling the door 10 to a track assembly 28. The roller assemblies 26 are mounted on the panels 14 and coupled to the track assembly 28 to guide the door 10 between the closed and open configurations. Each roller assembly 26 includes a roller 30 rotatably mounted on a post 32 which is inserted through each of a pair of flanges 34 on the hinge assembly 20. The track assembly 28 includes a pair of vertical sections 36 each of which are mounted to the wall 12 on opposite sides of the opening. The vertical sections 36 are each connected to a horizontal section 38 through a curved transition section 40 as is readily known by one skilled in the art. Each track section 36, 38, 40 has a generally J-shaped cross-sectional configuration into which each of the rollers 30 of the roller assemblies 26 is captured to assist in the movement and articulation of the door 10 to and between the closed and open configurations as the rollers 30 translate along the vertical, transition and horizontal sections of the track assembly 28.

Figure 2:
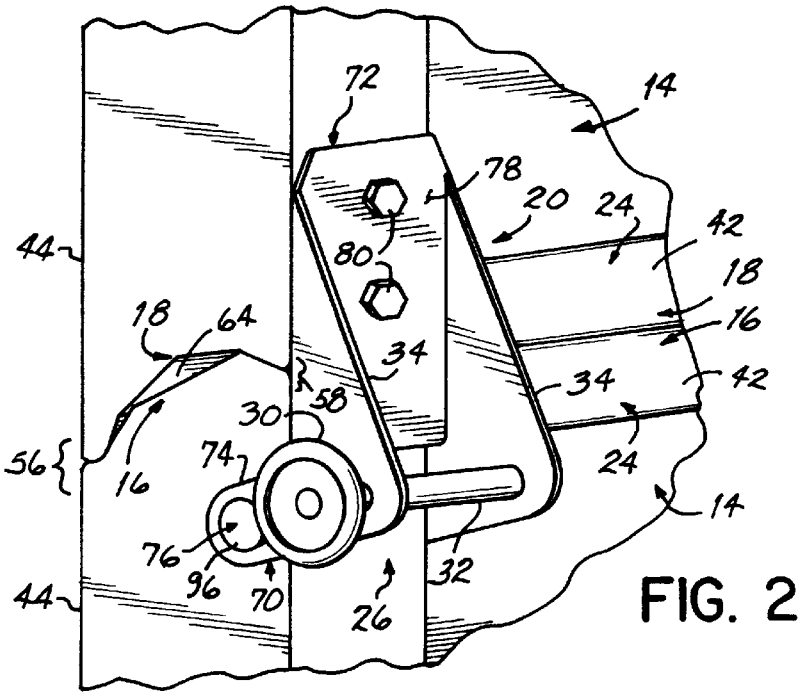
FIG. 2 is an enlarged fragmentary perspective view of the mating upper and lower edges of adjacent panels and the hinge and roller assembly coupling the panels together.
Figure 3:
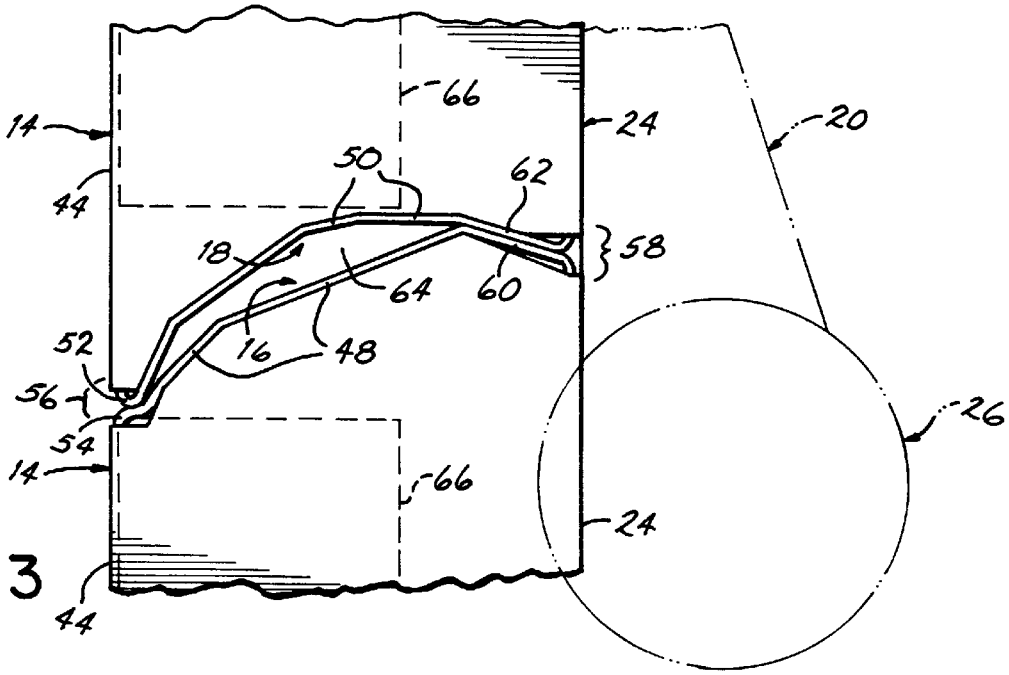
FIG. 3 is an enlarged side elevational view of the upper and lower edges of the adjacent panels showing two contact locations between the mating edges and a gap separating the contact locations.
Figure 4:
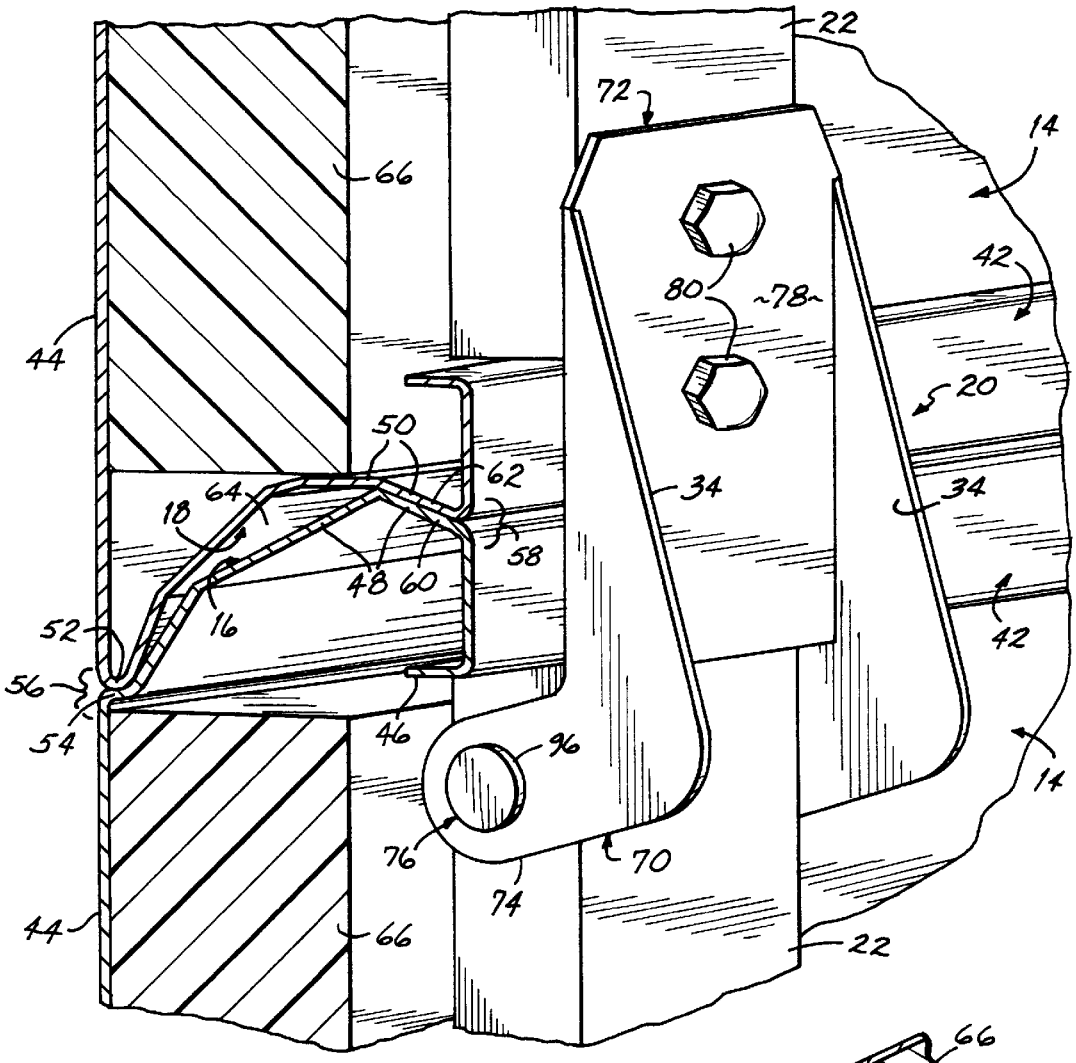
FIG. 4 is a perspective view of adjacent panels coupled together by a hinge assembly with the panels shown in cross section.

Referring to FIGS. 2–4, the upper and lower edges 16, 18 of the panels 14 are each finished with a rail 42 joined to the respective edges. The rail 42 includes the back face 24 which is generally parallel to a panel front face 44 and a terminal lip 46 which projects perpendicularly to the back face 24 and toward the front face 44. The lower edge 18 of each panel 14 has a generally concave configuration for mating with the upper generally convex shaped edge 16 of an adjacent panel 14. Preferably, the cross-sectional configuration of the convex upper edge 16 of each panel 14 is non-circular and comprises a plurality of generally linear segments 48 providing a polygonal configuration. Similarly, the concave shaped lower edge 18 of each panel 14 is also non-circular and comprises a plurality of generally linear segments 50 providing a polygonal configuration.

Figure 5:
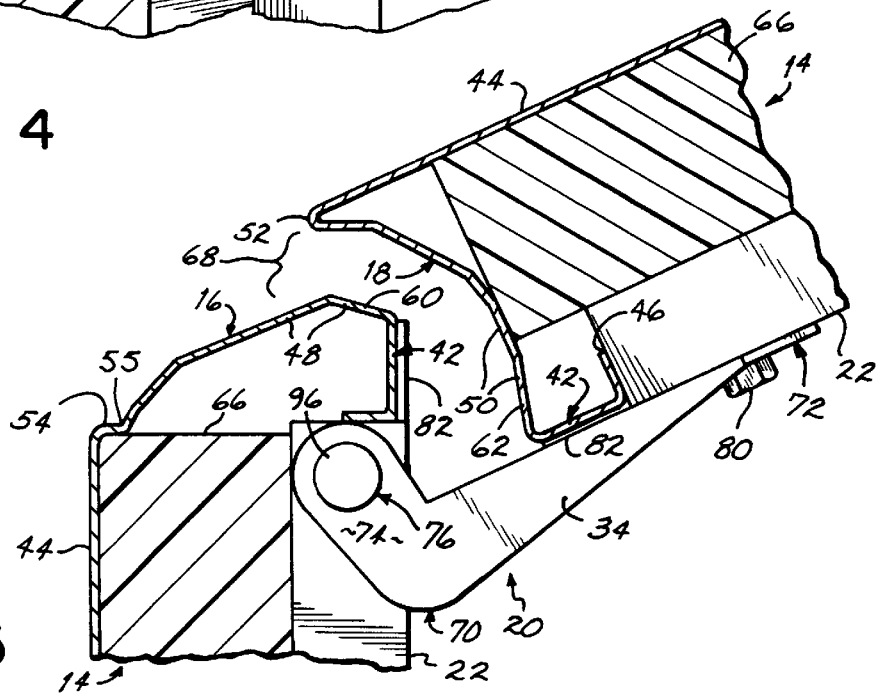
FIG. 5 is a cross-sectional view of mating upper and lower panels in which the upper panel is being pivoted through the hinge relative to the lower panel.

A rounded nose 52 is at the juncture between the front face 44 of the panel 14 and the lower edge 18. At the juncture between the front face 44 and upper edge 16 of the panel 14 is a shoulder 54 providing a landing area for the nose 52 when the door 10 is in the closed configuration as shown in FIGS. 2–4. In the closed configuration, the nose 52 on the lower edge 18 of the panel 14 contacts the shoulder 54 on the upper edge 16 of the adjacent panel 14 at the front faces 44 of the panels 14 thereby providing a first contact location 56 between the adjacent panels 14. Preferably, the radius of curvature of the nose 52 is as small as roll forming and other manufacturing techniques will reasonably permit to enhance the pinch resistance of this design. Further, a radius 55 as shown in FIG. 5 is preferably positioned as close to the front face 44 of the panel as possible to minimize the depth of the shoulder 54 and provide an ejection zone for ejecting any foreign objects from between the adjacent panels when the door is opening/closing.

A second contact location 58 between the adjacent upper and lower edges 16, 18 of the panels 14 is proximate the back face 24 of the panels 14 and includes an obliquely angled or, more specifically, a downwardly sloping interface between the upper and lower edges 16, 18 when the door 10 is in the closed configuration. The upper edge 16 of each panel 14 includes a generally planar surface 60 at the juncture between the rail 42 and the upper edge 16; whereas, the lower edge 18 also includes a generally planar surface 62 at the juncture between the lower edge 18 and the rail 42 of the panel 14. In the closed configuration, the planar surfaces 60, 62 on the upper and lower edges 16, 18 of the panels 14 are in contact and in one presently preferred embodiment in generally face-to-face or planar contact when the door 10 is in the closed configuration to form the second contact location 58. In a presently preferred embodiment of this invention, the planar surface 62 on the lower edge 18 of the panel 14 forms an angle of less than 90° with the back face 24 and, more preferably, an angle of approximately 75° with the back face 24. Similarly, in a presently preferred embodiment the planar surface 60 on the upper edge 16 of each panel 14 forms an angle of greater than 90° with the back face 24 and, more preferably, an angle of approximately 105° with the back face 24. It should be appreciated that other configurations are contemplated within the scope of this invention.

Due to the configuration of the mating upper and lower edges 16, 18 of the adjacent panels 14 and the first and second contact locations 56, 58, an uninterrupted gap 64 is provided between the first and second contact locations 56, 58.

A foam insert 66 may be included in each of the panels 14 and in a presently preferred embodiment is a generally rectangular block which is adhesively adhered as a backing to the front face 44 of the panel 14. Preferably, the foam insert 66 is preformed and then installed on the panel 14; alternatively, the foam insert 66 may be formed in-situ on the panel 14. As shown particularly in FIG. 4, the foam insert 66 does not fill the rails 42 at the upper and lower edges 16, 18 of the panel 14; however, reinforcing material (not shown) may be included in the nose 52 at the lower edge 18 of the panel 14 to minimize dents or the like in the panel 14.

Preferably, the front face 44, upper and lower edges 16, 18 and rails 42 of the panel 14 are roll formed from a single piece of metal, preferably aluminum or steel. Alternatively, the panel 14 may be injection or compression molded from a plastic composition, polymer or synthetic material.

Referring to FIG. 5, articulation of the adjacent panels 14 results in movement of the lower edge 18 relative to the upper edge 16 of the adjacent panel 14. However, due to the configuration of the upper and lower edges 16, 18 of the panels 14, a spacing 68 between the panels 14 is minimized and the configuration of the spacing 68 is optimized to inhibit the insertion of a foreign object such as a probe or the like (not shown) between the panels 14 during articulation. An important feature of the pinch resistant design is the configuration of the non-circular upper and lower edges 16, 18. Specifically, the polygonal, segmented shape of the lower edge 18 relative to the pivot axis of the hinge 20 assists in minimizing the opportunity for insertion of a foreign object and ejecting such an object once inserted.

Figure 9:
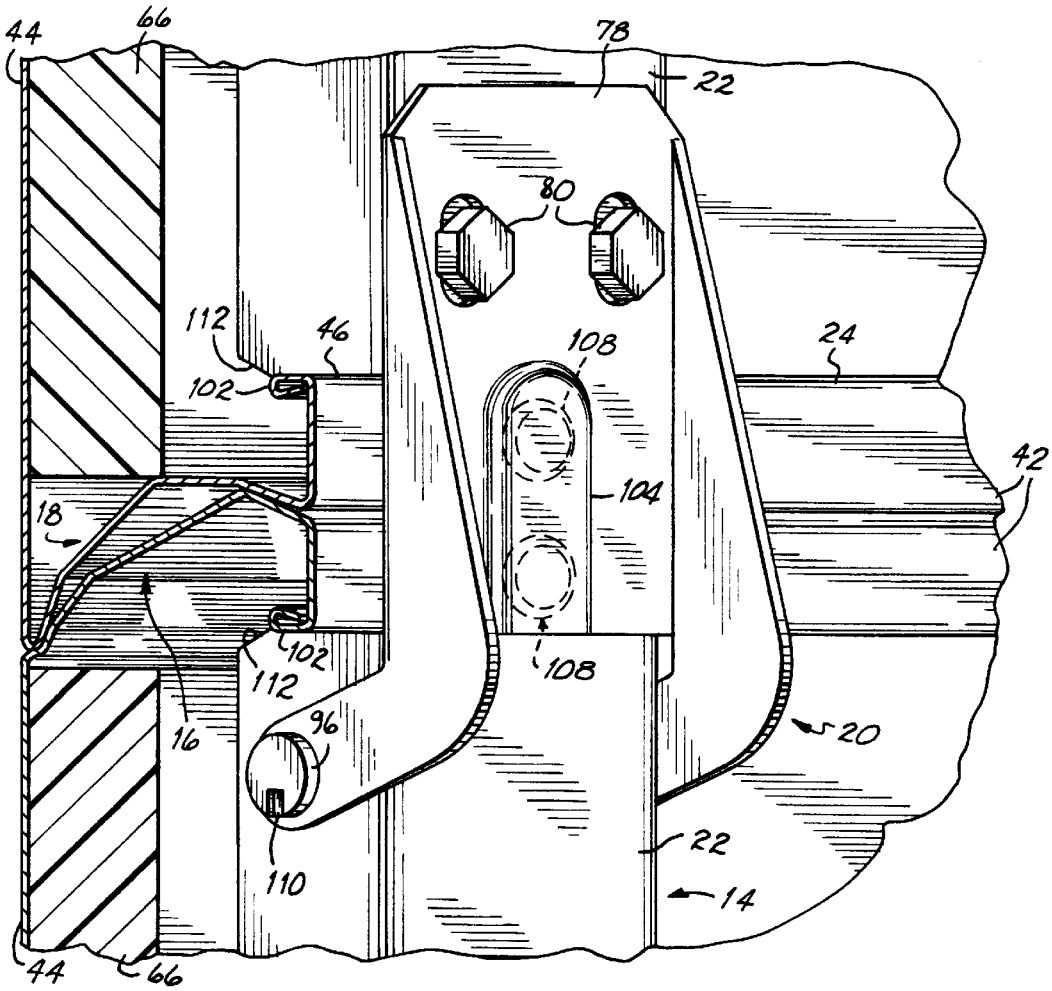
FIG. 9 is a perspective view similar to FIG. 4 of an additional preferred embodiment of adjacent panels and the associated hinge and stile assemblies.
Figure 10:
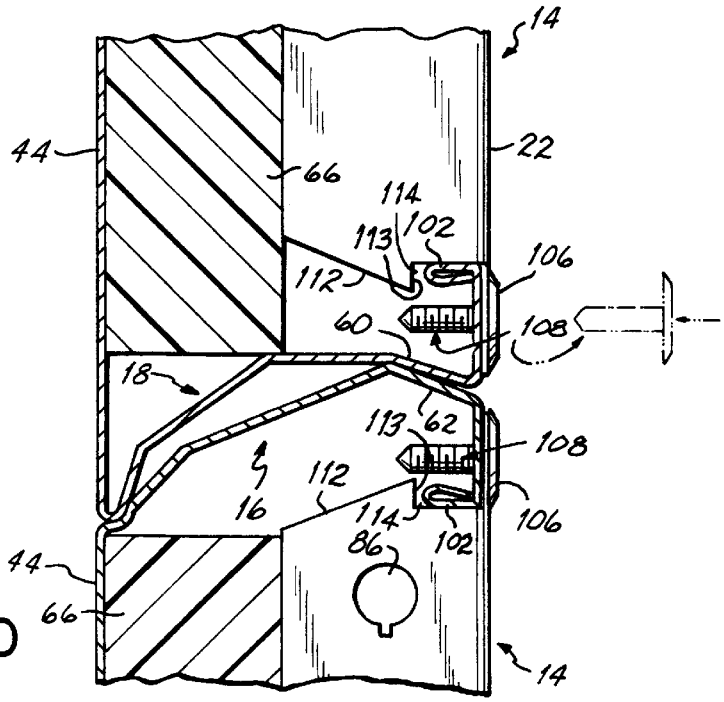
FIG. 10 is a cross-sectional view of the invention of FIG. 9 showing the attachment mechanism of the stiles to the panels.

Referring particularly to FIGS. 2, 4 and 5, the hinge assembly 20, according to a presently preferred embodiment of this invention, includes a first portion 70 which is attached to the stile 22 proximate the upper edge 16 of one panel 14 and a second portion 72 which is attached to the rail 42 and stile 22 proximate the lower edge 18 of the superjacent panel 14. The hinge 20 includes a pair of spaced and parallel generally L-shaped flanges 34 between which the stile 22 proximate the upper edge 16 of the panel 14 is positioned between legs 74 of the flanges 34 and a pivot pin 76 is inserted through the legs 74 and the stile 22. Overlying the back face of the rails 42 and the stiles 22 is a generally planar hinge plate 78 which is formed with the flanges 34. The hinge plate 78 is attached to the rail 42 and stile 22 proximate the lower edge 18 of the adjacent panel 14 by bolts, screws or other mechanical fasteners 80 which may include a slip-n-lock configuration. The fasteners 80 are shown in FIGS. 1–8 as being arranged vertically on the hinge plate 78; however, preferably the fasteners 80 are arranged horizontally (FIG. 9) on the hinge plate 78 to minimize rocking and flexure of the panels 14 during opening and closing. Preferably, upper and lower ends of each of the stiles 22 each include a tab 82 which is juxtaposed to the back face 24 of the panel 14 and may be secured thereto by a mechanical fastener (FIGS. 9–10).

As can be readily seen in FIG. 5, the pivot pin 76 provides a pivot axis for the hinge assembly 20 which is located within the profile of the panel 14 and inwardly of the back face 24 of the panel 14 and between the back face 24 and front face 44 thereof. Advantageously, positioning the pivot pin 76 and pivot axis of the hinge 20 inwardly from the back faces 24 of the panels 14 helps to minimize the spacing 68 between the upper and lower edges 16, 18 of the adjacent panels 14 during articulation of the panels 14 while opening and closing the door 10 and thereby enhance the pinch-resistant feature of this invention. Specifically, the non-circular polygonal configuration of the lower edge 18 with segments 50 which form a focal point generally at the pivot axis enhances the pinch resistant design (see FIG. 10).

Figure 6:
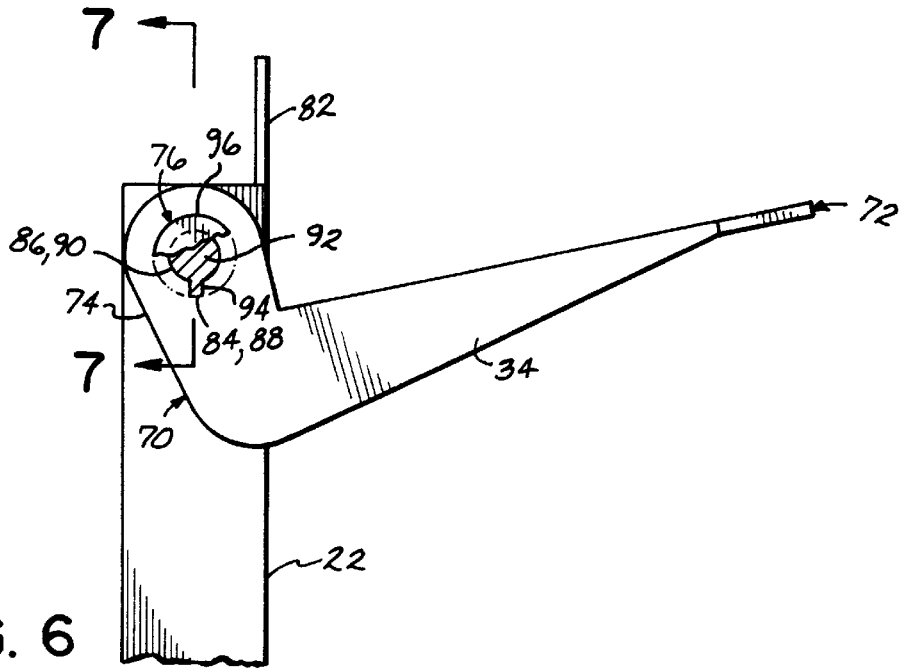
FIG. 6 is a cross-sectional view showing the alignment of the keyhole slots in the hinge and stile during installation of the hinge.
Figure 8:
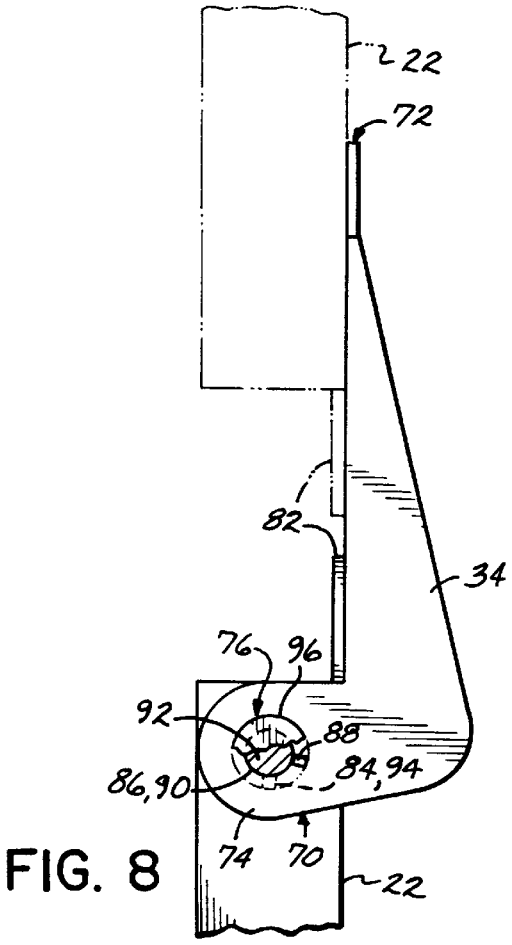
FIG. 8 is a view similar to FIG. 6 with the pivot pin inserted in the hinge which has been pivoted for connection to the adjacent panel and the keyhole slots being misaligned to capture the pivot pin in the hinge assembly.
Figure 7:
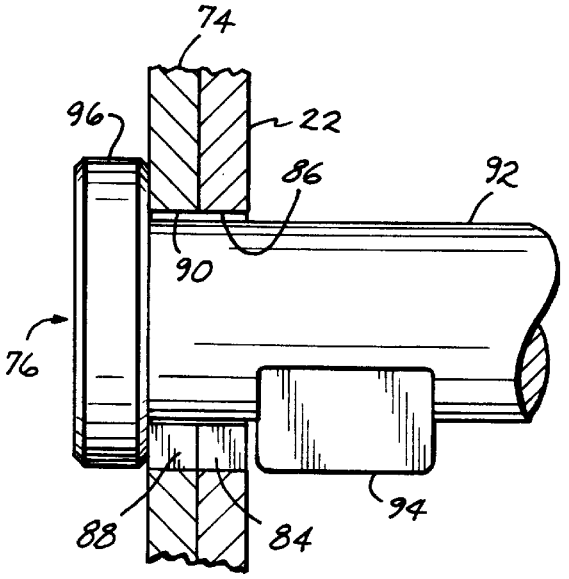
FIG. 7 is a cross-sectional view taken along line 7—7 of FIG. 6 showing a key on the pivot pin inserted through the aligned keyhole slots.

Referring particularly to FIGS. 6–8, the installation of the hinge 20 is a particularly advantageous feature of this invention. A keyhole slot 84 is included in a hole 86 in the stile 22 and a similar keyhole slot 88 is provided in a hole 90 in at least one of the flanges 34 on the hinge 20. The keyhole slots 84, 88 and associated holes 86, 90 are similarly sized and configured for the insertion of the pivot pin 76 therethrough. The pivot pin 76 includes a shaft 92 with a key 94 formed thereon and the key 94 is spaced from a head 96 of the pivot pin 76 (FIG. 7).

Installation of the hinge 20 on the panel 14 includes initially positioning the keyhole slots 84, 88 so that they are aligned one with the other which requires that the hinge plate 78 be rotated so that it is spaced from the stile 22 and back face 24 of the adjacent panel 14, as shown particularly in FIG. 6. Preferably, for the hinges 20 to be attached to the center stiles 22 the hinge plate 78 is spaced about 90 degrees from the stile 22 and the hinge plates 78 for the hinges 20 on the outer or roller stiles are spaced about 80 degrees from the stiles 22 when the keyhole slots 84, 88 are aligned. With the keyhole slots 84, 88 in the hinge 20 and stile 22 aligned, the pivot pin 76 can be inserted therethrough with the key 94 passing through the keyhole slots 84, 88 until the head 96 contacts the flange 34. Preferably, a terminal end 98 of the pivot pin 76 extends through the stile 22 and projects through a hole 100 in the opposite flange 34 on the hinge 20 (FIG. 1). For ease of assembly, if required, the keyhole slots on the end stiles face inward (i.e., toward the vertical centerline of the door). This orientation allows the pin 76 to be more easily removed without interference from the track 28. The keyhole slots 84 on the center stiles 22 are preferably located on both sides of the stiles 22 for easy insertion and removal of the pin 76 from either side.

After the pivot pin 76 is inserted, the key 94 is spaced from the head 96 to thereby provide clearance between the key 94 and the flange 34 and stile 22 to enable rotation of the hinge 20 relative to the stile 22. The hinge plate 78 is then rotated to be juxtaposed in face-to-face relationship with the stile 22 and back face 24 of the adjacent panel 14 as shown in FIG. 8. Rotation of the hinge 20 relative to the stile 22 repositions the keyhole slots 84, 88 so that they are misaligned or out of phase. Misalignment of the keyhole slots 84, 88 captures the pivot pin 76 and prevents its removal from the stile 22 as a result of the key 94 on the shaft 92 of the pivot pin 76. Once the hinge plate 78 is rotated into contact with the stile 22 and back face 24 of the adjacent panel 14, the hinge plate 78 is bolted, screwed or otherwise fastened to the adjacent panel 14. The hinge 20 is then installed and operational and the pivot pin 76 cannot be removed during articulation of the panels 14 and operation of the hinge 20 because the keyhole slots 84, 88 are secured out of phase or in a misaligned relationship and the key 94 cannot pass through both of the keyhole slots 84, 88 once the hinge 20 is assembled. Advantageously, the hinge 20 does not require an additional component such as a nut, cotter pin, rivet or the like to secure the pivot pin 76 to the hinge 20 and panel 14 thereby simplifying the installation procedure and inventory requirements associated with this invention.

The configuration of the panels 14 also provides significant benefits during the installation of the door 10. Specifically, as previously discussed, alignment and stackability of the panels 14 relative to one another is an important factor in proper installation of the door 10. Furthermore, once proper alignment of the panels 14 is obtained, maintaining their relative position during the installation procedure is equally important. The configuration of the mating upper and lower edges 16, 18 of the adjacent panels 14 is a significant benefit in this regard.

Specifically, installation of the door 10 includes stacking each of the panels 14 one upon another and constructing the door 10 in the closed configuration. Placement of a lower panel 14 and then stacking in edge-to-edge relation the next superjacent panel 14 with proper alignment between the panels 14 is easily accomplished with this invention. Once a lower panel 14 is positioned proximate the opening and relative to the track assembly 28 with the upper edge 16 exposed, an additional panel 14 is placed atop the previous panel 14 with the lower edge 18 being positioned atop the exposed upper edge 16 of the previous panel 14. Advantageously, complicated alignment procedures are not required to maintain the panels 14 so that the front faces 44 are generally coplanar because of the registration of the panels provided by the first and second contact locations 56, 58 between the mating upper and lower edges 16, 18 of the panels 14.

More particularly, the sloping interface between the planar surfaces 60, 62 at the second contact location 58 assists in the registration of the panels 14 relative to one another during installation. For example, if the upper panel 14 is positioned atop the lower panel 14 with the front face 44 of the upper panel 14 either in front of or behind the front face 44 of the lower panel 14, the sloping interface of the second contact 58 location in cooperation with the first contact location 56 will automatically align and register the panels 14 by gravity to provide for proper alignment of the panels 14 in a direction perpendicular to the front faces 44 of the panels.

Lateral alignment of the adjacent panels 14 is easily accomplished by shifting the panels 14 left or right relative to one another. Once this is accomplished, pivotally connecting the adjacent panels 14 together is achieved through installation of the hinge assembly 20 as previously described with reference to FIG. 6–8. Additionally, installation of the roller assemblies 26 is required during the installation process as is readily understood by one of ordinary skill in the art.

Figure 11:
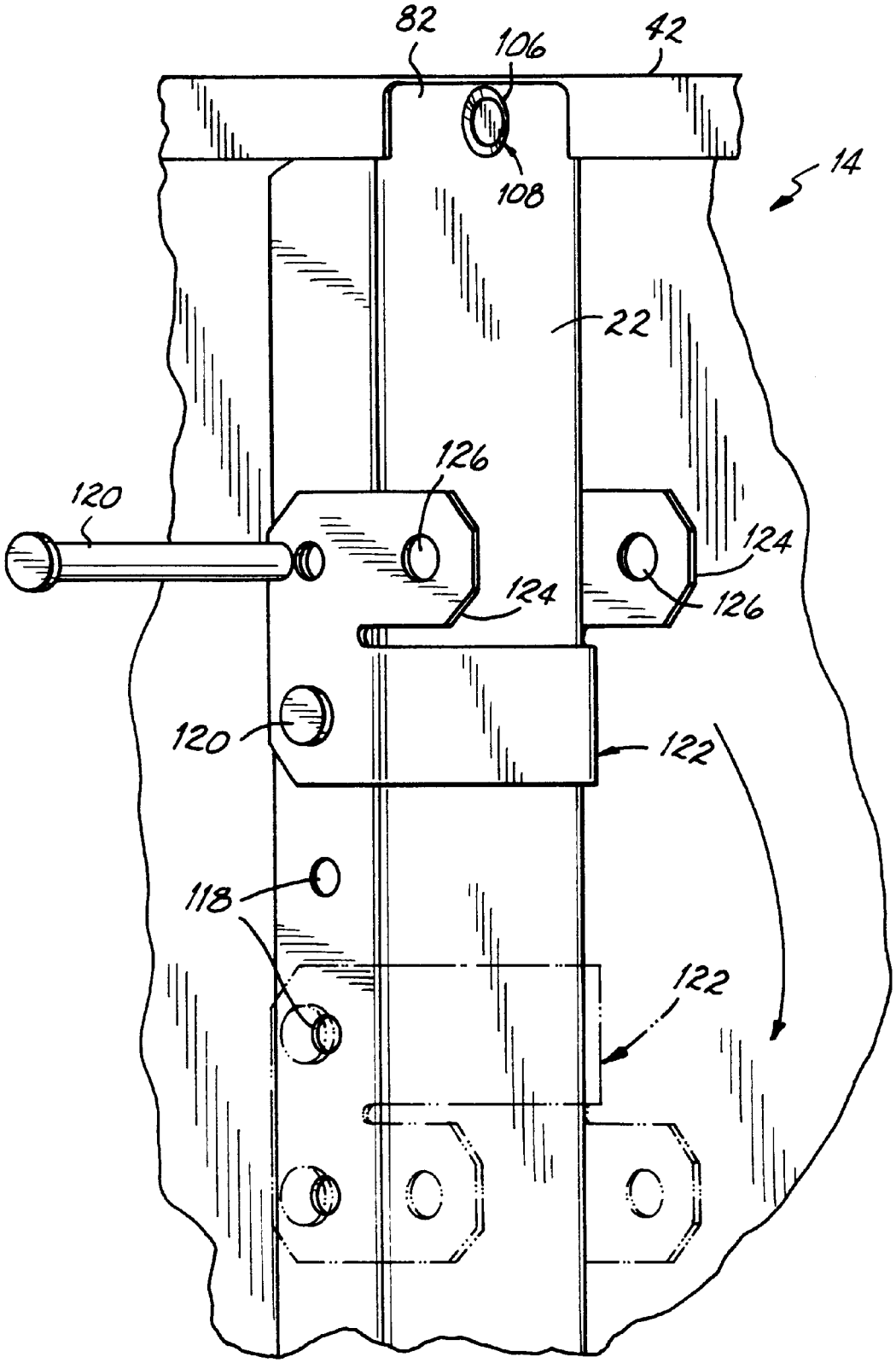
FIG. 11 is a perspective view of a preferred embodiment of a center stile and an operator bracket attached thereto.

A second presently preferred embodiment of this invention is shown in FIGS. 9–11 in which elements similar to those of the embodiment of FIGS. 1–8 are likewise numbered. As can readily be seen from FIGS. 9 and 10, a hem 102 is included on the terminal lip 46 of the rail 42 on the upper and lower edges 16, 18 of the respective panels 14. An additional feature of this presently preferred embodiment of the invention is the positioning in a side-by-side or horizontal orientation the bolts 80 which secure the hinge plate 78 to the stile 22. As previously mentioned, the side-by-side or horizontal orientation of the bolts 80 helps minimize rocking and flexure of the panels 14 during opening and closing.

Additionally, the hinge plate 78 includes a screw head recessed pocket 104 to conceal fastener heads 106 of fasteners 108 used to secure the tab 82 on the stile 22 to the respective back faces 24 of the panels 14 as will be described in more detail with reference to FIG. 10. An additional feature shown in FIG. 9 is the inclusion of an alignment mark 110 on the head 96 of the pivot pin 76. Advantageously, the alignment mark 110 is aligned with the key 94 projecting from the shaft 92 of the pivot pin 76 so that an installer can readily see the mark 110 and determine the orientation of the key 94 relative to the concealed keyhole slots 84, 88 during installation.

Referring to FIG. 10, the fastener 108 for securing the tab 82 on the upper and lower ends of the stile 22 can be readily inserted through aligned holes in the tab 82 and back face 24 of the rail 42. Advantageously, a single fastener 108 is required on each tab 82 for secure attachment to the rail 42. The fastener may be a screw, pop rivet or other mechanical device which may or may not require rotation for secure attachment.

The terminal end of each stile includes a sloped edge 112, a lip 113 and a notch 114 as shown in FIG. 10. Installation of the stile can be manually accomplished by vertically aligning the stile 22 between the rails 42 of the panel 14 and then popping, forcing or slamming each end of the stile 22 downwardly toward the panel 14 thereby temporarily deflecting the in-turned lip 46 as the slope edge 112 rides over the terminal lip 46 and hem 102 which are then seated within the notch 114. This assembly method for the stile 22 can be used for the center stiles and the lateral end stiles on each panel 14. Once again, the ease of installation by a professional or an unskilled garage door installer is readily apparent with this design. Moreover, the structural integrity of the stile 22 and panel 14 combination is enhanced because of the cooperation between a configuration of the stile 22 and the rail 42 of the panel 14 without a large number of mechanical fasteners, reinforcing members or the like. Specifically, the lip 113 in the notch 114 limits the downward deflection of the rail 42 during installation of the fastener 108.

An important feature of the invention is readily apparent from FIG. 10, namely the position of the focal point of the lower edge 18 relative to the pivot pin 76 or axis of articulation for the hinge 20. As previously described hereinabove, the non-circular, polygonal or linear segments 50 of the lower edge 18 is approximately coincident with the center of curvature of the lower edge 18. The cross-sectional configuration of the lower edge 18 of the panel 14 is non-circular with several polygonal sections or linear segments 50. The focus of lines extending perpendicular to each of the polygonal sections 50 at the midpoints of the faces of the polygons are focused at or near the pivot pin 76 or axis of articulation. Preferably, the center of curvature of the polygonal sections 50 defining the concaved lower edge 18 is generally concentric with the pivot pin 76 of the hinge 20 and substantially spaced from the back face 24 of the panels 14 toward the front face 44 of the panels 14. This design significantly aids in the pinch resistant feature of the design during articulation of the adjacent panels.

A further design feature of this embodiment of the invention is shown in FIG. 11 in which a plurality of holes 118, preferably at least five of which as shown in FIG. 11 are provided in one of the center stiles 22, likely on the uppermost panel 14 of the door 10. The holes 118 are sized and positioned for the insertion of a cotter pin 120 or other fastener to secure a generally U-shaped operator bracket 122 onto the center stile 22. The operator bracket 122 includes a pair of extending arms 124 having holes 126 therein for coupling to a garage door operator, mechanical opener or the like. Advantageously, a plurality of holes 118 are provided in the center stile 22 to position the bracket 122 at the appropriate position depending upon the specific configuration of the operator, garage door or the like.

As a result of the panel 14 configuration and hinge assembly 20 of this invention, an overhead door 10 can be easily and correctly installed with proper alignment of the panels 14 relative to one another. Furthermore, assembly of the stiles to the panels, installation and assembly of the hinge 20 pivotally coupling each of the adjacent panels 14 together and attachment of the operator bracket for a door opener are easily accomplished with a reduced number of parts. Therefore, the overhead door 10 is easily and efficiently installed with a minimum number of parts to provide a pinch-resistant, properly operating overhead door 10.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

What is claimed is:

1. An overhead door capable of being selectively moved between a generally horizontal open configuration and a generally vertical closed configuration covering an opening, the door comprising:

a plurality of serially connected panels each having a front face and a back face;

a plurality of hinges proximate the back faces and joining adjacent panels;

a track assembly mounted proximate the opening, the track assembly including a generally vertical section, a generally horizontal section and a transition section joining the horizontal and vertical sections together; and a plurality of rollers mounted on the panels and coupled to the track assembly to guide the door between the closed and open configurations, wherein selected ones of the panels further comprise:

a) an upper edge separated from a lower edge by the front face, the upper edge of each panel mating with the lower edge of an adjacent panel;

b) first and second load bearing contact locations between the upper and lower edges of adjacent panels, the contact locations supporting a substantial portion of the weight of superjacent panels, being separated by a gap and cooperating to inhibit the insertion of a foreign object between the adjacent panels during movement of the panels to and between the open and closed configurations of the door, the first contact location being substantially at the juncture between the respective front faces of the adjacent panels and portions of the respective lower and upper edges of the adjacent panels, the second contact location being proximate the back face of the panels and including a downwardly sloping interface between the upper and lower edges of the adjacent panels when the door is in the closed configuration to aid in the alignment of the panels.

2. The door of claim 1 wherein the first contact location is proximate the front faces of the adjacent panels.

3. The door of claim 1 wherein the lower edge includes a generally concave configuration and the upper edge includes a generally convex configuration.

4. The door of claim 1 wherein a cross-sectional configuration of the upper and lower edges are each non-circular and comprise a plurality of generally linear segments.

5. The door of claim 1 further comprising:

a nose at the juncture between the front face and the lower edge of the panel; and a shoulder at the juncture between the front face and upper edge of the panel, wherein the nose rests upon the shoulder of the subjacent panel to form the first contact location when the door is in the closed configuration.

6. The door of claim 1 further comprising:

a pair of generally planar surfaces one of which is on the upper edge and the other of which is on the lower edge, the pair of generally planar surfaces being in face-to-face contact between the adjacent panels when the door is in the closed configuration to form the second contact location.

7. The door of claim 1 further comprising:

a pair of generally planar surfaces one of which is on the upper edge and the other of which is on the lower edge, the pair of generally planar surfaces having a line of contact between adjacent panels when the door is in the closed configuration to form the second contact location.

8. The door of claim 1 further comprising:

a foam insert on each panel and positioned between the upper and lower edges and backing the front face thereof.

9. The door of claim 1 further comprising:

a rail on the upper and lower edges of the panels, the rail comprising the back face extending generally parallel to the front face and a terminal lip projecting from the back face toward the front face.

10. The door of claim 1 further comprising:

a stile on each panel extending between the upper and lower edges thereof;

a first portion of each hinge being attached to the stile on a first panel and a second portion of each hinge being attached to the stile on a second adjacent panel; and a pivot pin extending through the second portion of the hinge and the stile on the second panel.

11. The door of claim 10 further comprising:

a pair of keyhole slots one of which is in the stile and the other of which is in the second portion of the hinge; and a key on the pivot pin adapted to pass through the pair of keyhole slots when they are aligned for insertion of the pivot pin into the hinge and the stile, the key preventing the removal of the pivot pin from the stile when the hinge is installed on the adjacent panels and the keyhole slots are misaligned.

12. An overhead door capable of being selectively moved between a generally horizontal open configuration and a generally vertical closed configuration covering an opening, the door comprising:

a plurality of serially connected panels;

a plurality of hinges joining adjacent panels;

a track assembly mounted proximate the opening, the track assembly including a generally vertical section, a generally horizontal section and a transition section joining the horizontal and vertical sections together; and a plurality of rollers mounted on the panels and coupled to the track assembly to guide the door between the closed and open configurations;

wherein selected ones of the panels further comprise:

a) a front face and a back face, the hinges being proximate to the back face of each panel;

b) an upper edge having a generally non-circular convex configuration separated by the front face from a lower edge having a generally non-circular concave configuration, the upper edge of each panel mating with the lower edge of an adjacent panel, wherein a cross-sectional configuration of the upper and lower edges each comprise a plurality of generally linear segments;

c) a rail on the upper and lower edges of the panels, the rail comprising the back face extending generally parallel to the front face and a terminal lip projecting from the back face toward the front face;

d) first and second load bearing contact locations between the upper and lower edges of the adjacent panels, the contact locations supporting a substantial portion of the weight of superjacent panels and being separated by a gap, the first contact location being proximate the front faces of the adjacent panels to inhibit the insertion of a foreign object between the adjacent panels during movement of the panels to and between the open and closed configurations of the door, the second contact location being proximate the back face of the panels and including a downwardly sloping interface between the upper and lower edges of the adjacent panels when the door is in the closed configuration to aid in the alignment of the panels;

e) a nose at the juncture between the front face and the lower edge of the panel;

f) a shoulder at the juncture between the front face and upper edge of the panel, wherein the nose rests upon the shoulder of the subjacent panel to form the first contact location when the door is in the closed configuration; and g) a pair of generally planar surfaces one of which is on the upper edge and the other of which is on the lower edge, the pair of generally planar surfaces being in contact when the door is in the closed configuration to form the second contact location.

13. The door of claim 12 further comprising:

a foam insert positioned between the upper and lower edges and backing the front face of each panel.

14. The door of claim 12 wherein a pivot axis of each of the hinges is positioned between the front face and the back face of one of the panels.

15. The door of claim 14 further comprising:

a stile on each panel extending between the upper and lower edges thereof;

a first portion of each hinge being attached to the stile on a first panel and a second portion of each hinge being attached to the stile on a second adjacent panel; and a pivot pin extending through the second portion of the hinge and the stile on the second panel.

16. A method of assembling an overhead door capable of being moved between a generally horizontal open configuration and a generally vertical closed configuration covering an opening, the method comprising:

stacking a plurality of panels one atop another such that a lower edge of each panel mates with an upper edge of the subjacent panel, the mating upper and lower edges of adjacent panels having first and second load bearing contact locations separated by a gap in which the contact locations support a substantial portion of the weight of the superjacent panel;

aligning the adjacent panels with each other by the contact locations, the first contact location being substantially at the juncture between respective front faces of the adjacent panels and portions of the respective lower and upper edges of the adjacent panels the second contact location being proximate a back face of the panels and includes an interface between the upper and lower edges of the adjacent panels and being oriented obliquely with respect to the face of the panels to aid in the alignment of the panels during the assembly of the door; and hingedly connecting the adjacent panels.

17. The method of claim 16 wherein the stacking of the panels further comprises positioning a nose of the superjacent panel onto a shoulder of the subjacent panel to form the first contact location between the adjacent panels, the first contact location being proximate the front face of the panels and the second contact location being proximate the back face of the panels to inhibit the insertion of a foreign object between the adjacent panels when the assembled door is being moved between the closed and open configurations.

18. The method of claim 17 wherein the stacking and aligning of the panels results in generally line contact between the adjacent panels at the first contact location and generally planar contact between the adjacent panels at the second contact location.

19. The method of claim 18 further comprising:

installing a track system proximate the opening, the track system including a generally vertical section, a generally horizontal section and a transition section joining the horizontal and vertical sections together;

mounting rollers on selected panels; and coupling the rollers to the track system;

wherein the stacking and aligning are accomplished with the panels in a generally vertical configuration and the rollers are initially coupled to the generally vertical section of the track system.

20. The method of claim 16 wherein the hingedly connecting of the panels further comprises:

aligning a keyhole slot in a hinge with a mating keyhole slot in one of the adjacent panels;

inserting a key of a pivot pin through the aligned keyhole slots;

rotating the hinge relative to the one of the adjacent panels having the keyhole slot to thereby misalign the keyhole slots and secure the pivot pin and the hinge to the one of the adjacent panels; and securing the hinge to the other of the adjacent panels.

21. A panel for an overhead door comprising a plurality of the panels pivotally connected and capable of being moved between a generally horizontal open configuration and a generally vertical closed configuration covering an opening, the panel comprising:

a front face and a back face;

a portion of a hinge coupled to the panel proximate the back face;

an upper edge separated from a lower edge by the front face, the upper edge of the panel for mating with the lower edge of an adjacent similar panel;

first and second contact load bearing locations on each of the upper and lower edges of the panel when juxtaposed generally vertically relative to another similar panel, the contact locations supporting a substantial portion of the weight of superjacent panels, being separated by a gap and cooperating to inhibit the insertion of a foreign object between the adjacent panels during movement of the panels to and between the open and closed configurations of the door, the first contact location being substantially at the juncture between the associated front faces of the adjacent panels and portions of the associated lower and upper edges of the adjacent panels, the second contact location being proximate the back face of the panels and including an obliquely angled interface between the upper and lower edges of the adjacent panels when the door is in the closed configuration to aid in the alignment of the panels.

22. The panel of claim 21 wherein the first contact location is proximate the front face of the panel.

23. The panel of claim 21 wherein the lower edge includes a generally concave configuration and the upper edge includes a generally convex configuration.

24. The panel of claim 21 wherein a cross-sectional configuration of the upper and lower edges are each non-circular and comprise a plurality of generally linear segments.

25. The panel of claim 21 further comprising:

a nose at the juncture between the front face and the lower edge of the panel; and a shoulder at the juncture between the front face and upper edge of the panel, wherein the nose rests upon the shoulder of the subjacent panel to form the first contact location when the door is in the closed configuration.

26. The panel of claim 21 further comprising:

a pair of generally planar surfaces one of which is on the upper edge and the other of which is on the lower edge, the upper edge generally planar surface and lower edge generally planar surface have at least line contact with the lower edge generally planar surface and the upper edge generally planar surface, respectively, of the adjacent panel when the door is in the closed configuration to form the second contact location.

27. The panel of claim 21 further comprising:

a foam insert positioned between the upper and lower edges and backing the front face thereof.

28. The panel of claim 21 further comprising:

an upper and a lower rail on the upper and lower edges, respectively, of the panels, each rail comprising a back face extending generally parallel to the front face and a terminal lip projecting from the back face toward the front face.

29. The panel of claim 21 further comprising:

a hinge connected to the panel, wherein a pivot axis of the hinges is positioned between the front face and the back face of the panel.

30. The panel of claim 29 further comprising:

a stile extending between the upper and lower edges of the panel;

a first portion of the hinge being attached to the stile and a second portion of the hinge being attached to the stile on the adjacent panel; and a pivot pin extending through the first portion of the hinge and the stile.

31. The panel of claim 30 further comprising:

a pair of keyhole slots one of which is in the stile and the other of which is in the first portion of the hinge; and a key on the pivot pin adapted to pass through the pair of keyhole slots when they are aligned for insertion of the pivot pin into the hinge and the stile, the key preventing the removal of the pivot pin from the stile when the hinge is installed on the adjacent panels and the keyhole slots are misaligned.

32. A panel for an overhead door comprising a plurality of the panels pivotally connected and capable of being moved between a generally horizontal open configuration and a generally vertical closed configuration covering an opening, the panel comprising:

a front face and a back face;

an upper generally convex edge separated from a lower generally concave edge by the front face, the upper edge of the panel for mating with the lower edge of an adjacent similar panel;

first and second load bearing contact locations on each of the upper and lower edges of the panel when juxtaposed generally vertically relative to another similar panel, the contact locations for supporting a substantial portion of the weight of superjacent panels, being separated by a gap and cooperating to inhibit the insertion of a foreign object between the adjacent panels during movement of the panels to and between the open and closed configurations of the door, the first contact location being proximate the front face and the second contact location being proximate the back face of the panels;

a nose at the juncture between the front face and the lower edge of the panel; and a shoulder at the juncture between the front face and upper edge of the panel, wherein the nose is adapted to rest upon the shoulder of the adjacent panel to form the first contact location when the door is used in combination with adjacent panels and is in the closed configuration;

an upper and a lower rail on the upper and lower edges, respectively, of the panels, each rail comprising the back face extending generally parallel to the front face and a terminal lip projecting from the back face toward the front face; and a pair of generally planar surfaces one of which is on the upper edge and the other of which is on the lower edge, said generally planar surfaces being obliquely angled with respect to the back face, the upper edge generally planar surface and lower edge generally planar surface adapted to be in face-to-face contact with the lower edge generally planar surface and the upper edge generally planar surface, respectively, of the adjacent panel when the panel is used in combination with adjacent panels and is in the closed configuration to form the second contact location.

33. The panel of claim 32 wherein a cross-sectional configuration of the upper and lower edges each comprise a plurality of generally linear segments.

34. The panel of claim 32 further comprising:

a foam insert positioned between the upper and lower edges and backing the front face thereof.

35. A method of-assembling a garage door panel comprising the steps of:

positioning a stile generally perpendicularly to and between upper and lower laterally extending spaced and parallel rails of the panel, a face of the panel extending between the upper and lower rails thereof, the stile having a notch on each end thereof each with first and second portions;

moving each end of the stile toward the panel to engage a respective one of the rails of the panel;

temporarily deflecting at least a part of the respective rail with the first portion of the associated notch until a part of the rail is positioned between the first and second portions of the notch and the first portion of the notch is positioned between the face and the part of the rail; and applying a fastener to fasten the end of the stile to the respective rail.

36. The method of claim 35 wherein the part of the rail that is temporarily deflected is a terminal lip of each rail.

* * * * *